US006213846B1

(12) United States Patent
Li et al.

(10) Patent No.: US 6,213,846 B1
(45) Date of Patent: Apr. 10, 2001

(54) REAL-TIME CONTROL OF CHEMICAL-MECHANICAL POLISHING PROCESSES USING A SHAFT DISTORTION MEASUREMENT

(75) Inventors: Leping Li; Xinhui Wang, both of Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/351,436

(22) Filed: Jul. 12, 1999

(51) Int. Cl.[7] ..... B24B 49/00

(52) U.S. Cl. ..... 451/6; 451/2; 451/5; 451/8; 451/285; 451/287; 451/288

(58) Field of Search ..... 451/6, 7, 5, 2, 451/41, 285, 286, 287, 289, 63, 8; 216/84, 88, 89

(56) References Cited

U.S. PATENT DOCUMENTS

| | | | | |
|---|---|---|---|---|
| 4,910,155 | | 3/1990 | Cote et al. | 437/8 |
| 4,975,569 | * | 12/1990 | Ebina et al. | 250/231.16 |
| 5,036,015 | | 7/1991 | Sandhu et al. | 437/8 |
| 5,069,002 | | 12/1991 | Sandhu et al. | 51/165 R |
| 5,308,438 | | 5/1994 | Cote et al. | 156/636 |
| 5,337,015 | * | 8/1994 | Lustig et al. | 324/671 |
| 5,474,813 | * | 12/1995 | Walker et al. | 427/510 |
| 5,595,526 | | 1/1997 | Yau et al. | 451/8 |
| 5,639,388 | | 6/1997 | Kimura et al. | 216/84 |
| 5,643,044 | | 7/1997 | Lund | 451/5 |
| 5,644,221 | * | 7/1997 | Li et al. | 324/71.5 |
| 5,730,642 | * | 3/1998 | Sandhu et al. | 451/6 |
| 5,734,108 | * | 3/1998 | Walker et al. | 73/650 |
| 5,811,754 | * | 9/1998 | Nakatani et al. | 219/121.83 |
| 5,964,643 | * | 10/1999 | Birang et al. | 451/6 |
| 6,004,187 | * | 12/1999 | Nyui et al. | 451/5 |

FOREIGN PATENT DOCUMENTS

| | | |
|---|---|---|
| 6-315850 | 11/1994 | (JP) . |
| 9-070751 | 3/1997 | (JP) . |

* cited by examiner

*Primary Examiner*—Lee Young
*Assistant Examiner*—Minh Trinh
(74) *Attorney, Agent, or Firm*—Jay H. Anderson

(57) ABSTRACT

A method is provided for detecting the endpoint of a film removal process such as chemical-mechanical polishing (CMP). The process uses a device having a shaft, and friction in the film removal causes torque on the shaft. Two axially displaced reflecting portions are provided on the shaft. Light reflected from these portions generates first and second reflected signals, respectively. A phase difference between the reflected signals is detected, and an output signal is generated in accordance therewith. A change in the output signal indicates a change in deformation of the shaft resulting from change in the torque, thereby indicating the endpoint of the film removal process.

7 Claims, 4 Drawing Sheets

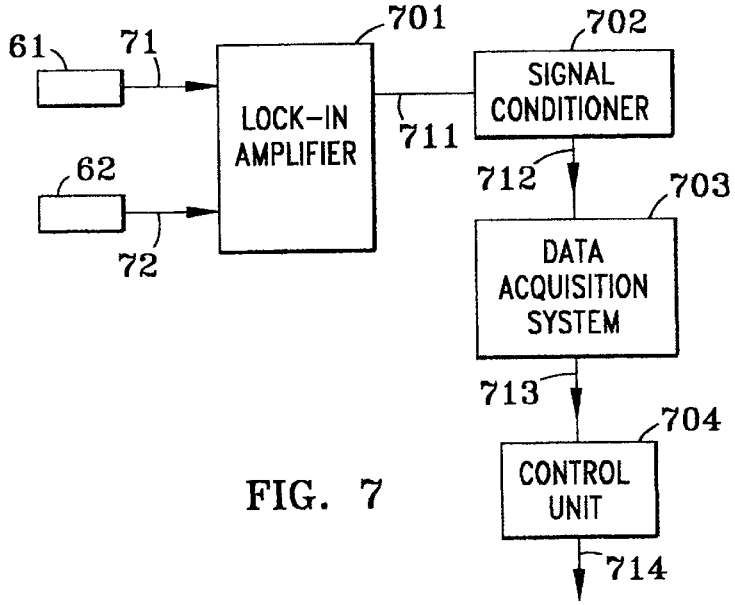
FIG. 7
FIG. 8A
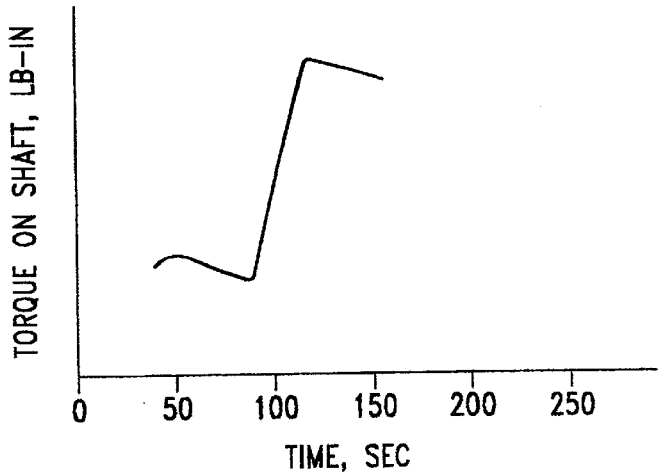
FIG. 8B
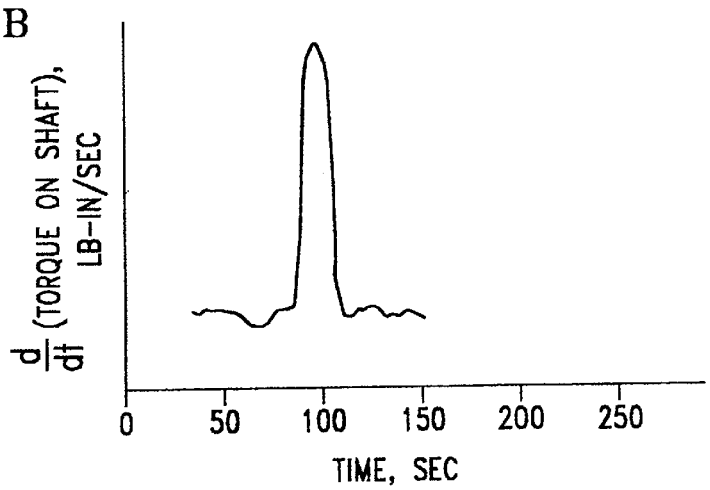

REAL-TIME CONTROL OF CHEMICAL-MECHANICAL POLISHING PROCESSES USING A SHAFT DISTORTION MEASUREMENT

FIELD OF THE INVENTION

This invention relates to semiconductor processing, and more particularly to detection of the endpoint for removal of one film overlying another film.

BACKGROUND OF THE INVENTION

In the semiconductor industry, critical steps in the production of integrated circuits are the selective formation and removal of films on an underlying substrate. Typical processing steps involve (1) depositing a film; (2) patterning areas of the film using lithography and etching; (3) depositing a film which fills the etched areas; and (4) planarizing the structure by etching or chemical-mechanical polishing (CMP).

In film removal processes, it is extremely important to stop the process when the correct film thickness has been removed (that is, when the endpoint has been reached). In a typical CMP process, a film is selectively removed from a semiconductor wafer by rotating the wafer against a polishing pad (or moving the pad against the wafer, or both) with a controlled amount of pressure in the presence of a slurry. Overpolishing (removing too much) of a film renders the wafer unusable for further processing, thereby resulting in yield loss. Underpolishing (removing too little) of the film requires that the CMP process be repeated, which is tedious and costly. Underpolishing may sometimes go unnoticed, which also results in yield loss.

In a number of CMP processes, it is necessary to measure the thickness of the layer to be removed and the polishing rate for each wafer, in order to determine a desired polishing time. The CMP process is simply run for this length of time, and then stopped. Since many different factors influence the polishing rate, and the polishing rate itself can change during a process, this approach is far from satisfactory.

A number of other methods have been suggested for obtaining reliable endpoint detection in CMP processing. In general, these methods each have inherent disadvantages, such as a lack of sensitivity, an inability to provide real-time monitoring, applicability to only certain types of films, or requiring removal of the wafer from the process apparatus to test for endpoint.

U.S. Pat. No. 5,559,428 to Li et al. describes an in-situ endpoint detection scheme for conductive films, using an induction method. There remains a need for an in-situ, real-time endpoint detection scheme suitable for use with nonconductive films. Such a scheme should also have high detection sensitivity and fast response time. In addition, it is desirable that the detection apparatus be robust, inexpensive and require little maintenance.

One important CMP process involves removal of a polycrystalline silicon (poly-Si) film overlying a patterned film of silicon dioxide ($SiO_2$) or silicon nitride ($Si_3N_4$); after removal of a blanket layer of poly-Si, a surface having partly poly-Si and partly $SiO_2$ or $Si_3N_4$ will be exposed. FIG. 1 shows a typical CMP apparatus 10 in which a workpiece 100 (such as a silicon wafer) is held face down by a wafer carrier 11 and polished using a polishing pad 12 located on a polishing table 13; the workpiece is in contact with slurry 14. The wafer carrier 11 is rotated by a shaft 15 driven by a motor 16. 2A is a detail view showing a patterned oxide layer 102 with an overlying layer 104 of poly-Si. Generally, it is necessary to remove the target film of poly-Si down to a level 105 so as to completely expose the oxide pattern, while leaving the oxide layer itself essentially intact (see FIG. 2B). Accordingly, a successful endpoint detection scheme must detect exposure of the oxide layer with very high sensitivity, and automatically stop the CMP process within a few seconds after the oxide becomes exposed (that is, no operator intervention should be required when endpoint is reached). Furthermore, the endpoint detection scheme should be effective regardless of the pattern factor of the wafer (that is, even if the area of the exposed underlying oxide layer is a small portion of the total wafer area).

One widely used approach to monitor and control a CMP process is to monitor a change in the motor current associated with a change in friction between (a) the top surface of the polishing pad 12 and (b) the slurry 14 and the surface being polished (such as the surface of wafer 100). This method is satisfactory when there is a significant change in friction as the underlying layer is exposed. However, for many applications, including the poly-Si polishing process described just above, the change in friction associated with the interface between layers is too small to result in a motor current change sufficient to be a reliable indicator of CMP process endpoint. This problem is aggravated by a large noise component in the motor current associated with the typical feedback servo current used to drive the wafer carrier at a constant rotational speed. In addition, a small pattern factor (that is, a relatively small area of the underlying patterned layer, compared with the area of the target layer) causes only a small change in friction as the endpoint is reached, limiting the useful signal.

When the motor current approach is used, an adequate signal-to-noise ratio may sometimes be obtained by varying process parameters (such as downward pressure on the polishing pad and relative rotational speed of the table and wafer carrier). Accordingly, optimization of process parameters for endpoint detection compromises other aspects of the CMP process, thereby compromising the product wafer quality.

SUMMARY OF THE INVENTION

The present invention addresses the above-described need for endpoint detection and control of a film removal process by providing a sensitive, real-time method of endpoint detection. In particular, the present invention overcomes the above-described problems inherent in the motor current monitoring approach.

The present invention will be described with reference to chemical-mechanical polishing of a semiconductor wafer merely as a specific example, and is not meant to limit applicability of the invention to semiconductor processing technology. Those skilled in the art will appreciate that the invention is broadly applicable to any process in which it is desirable to detect the endpoint for removal of a target film overlying a stopping film, using an apparatus having a shaft that experiences a change in torque when the target film is removed. In accordance with the present invention, this is done by detecting deformation of the shaft caused by torque on the shaft, and generating a signal in accordance with the deformation of the shaft.

According to a first aspect of the invention, the deformation of the shaft is detected by a sensor mounted directly on the shaft, or embedded in the shaft. A detector for the signal is provided; the signal is transmitted from the shaft and received at the detector. A change in the signal a change in the torque. This signal can be correlated to the process endpoint, thereby providing real-time monitoring capability and process control.

According to a second aspect of the invention, reflecting and non-reflecting portions are provided in two axially separated locations on the shaft, and laser beams are directed at both locations. As the shaft rotates, a reflecting portion at each location momentarily directs the beam into a detector, so that a train of reflected pulses enters each detector. Deformation of the shaft causes a change in the phase relationship between the two trains of pulses, which in turn indicates a change in the torque. This change is then detected and interpreted as a process endpoint signal.

The endpoint detection method of the present invention may include a step of stopping the film removal process when the endpoint has been reached, thereby providing automatic control of the film removal process.

According to another aspect of the invention, an apparatus for detecting the endpoint of a film removal process is provided. The film removal process is performed using a device having a shaft, where friction in the film removal process causes torque on the shaft. This apparatus includes: a sensor disposed on the shaft to detect deformation of the shaft caused by the torque on the shaft, the sensor generating a signal in accordance with the deformation of the shaft; a detector for receiving the signal; and a transmitter for transmitting the signal to the detector. The apparatus may also include a controller for stopping the film removal process when the endpoint has been reached.

According to a further aspect of the invention, an apparatus for detecting the endpoint of a film removal process is provided, for use with a film removal apparatus having a rotating shaft, where friction from the film removal process causes torque on the shaft. The endpoint detection apparatus includes first and second reflecting portions disposed on the shaft, axially displaced from each other; these portions reflect incident light and thereby generate respectively a first reflected signal and a second reflected signal. A first detector and a second detector detect the first and second reflected signals, respectively. Another detector detects a phase difference between the first reflected signal and the second reflected signal, and generates an output signal in accordance with the phase difference. A change in the phase difference indicates a change in deformation of the shaft resulting from a change in the torque on the shaft, thereby indicating the endpoint of the film removal process. This apparatus may also include a signal processor for processing the output signal to obtain a control signal for the film removal process, and a controller for controlling the film removal process in accordance with the control signal.

BRIEF DESCRIPTION OF THE DRAWINGS

FIG. 7 is a schematic illustration of a signal processing arrangement which processes and uses an endpoint signal in accordance with the second embodiment of the present invention.

FIG. 8A shows an example of a signal acquired during a CMP process, indicating the process endpoint.

FIG. 8B shows the time derivative of the signal of FIG. 8A.

DETAILED DESCRIPTION OF THE PREFERRED EMBODIMENTS

Details of the present invention will be discussed with reference to removal of a poly-Si film overlying a patterned silicon dioxide film.

Figure 3:
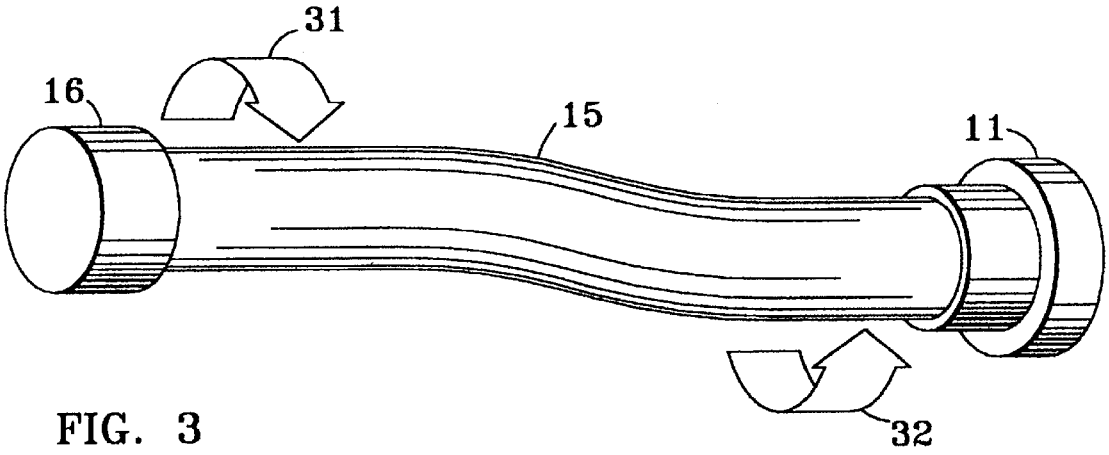
FIG. 3 is a schematic illustration of torque-induced deformation of a shaft.

In accordance with the present invention, changes in friction between the surface of the wafer 100 and the polishing pad 12, in the presence of the slurry 14, are monitored by directly monitoring the deformation of the carrier shaft 15. During a polishing process, the shaft 15 driving the wafer carrier 11 can experience changes in torque, bending, thrust and tension. Torque on the shaft (for example, due to rotation by motor 16 in direction 31 being opposed by frictional forces in direction 32) will induce deformation of the shaft, as shown schematically in FIG. 3. The degree of deformation depends on the diameter of the shaft, with smaller-diameter shafts being more susceptible to deformation. Such deformations can be measured with extremely high sensitivity at reasonable cost.

First Embodiment: Strain Gauge Measurement

Figure 1:
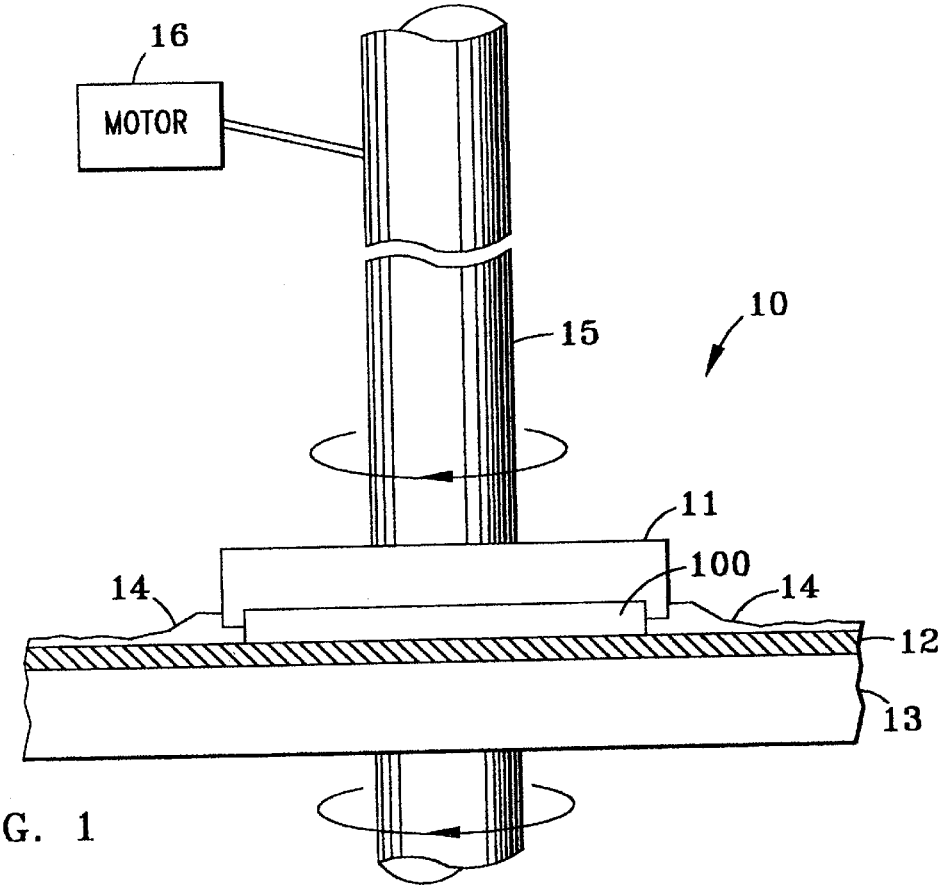
FIG. 1 is a general view of a typical chemical-mechanical polishing (CMP) arrangement to which the present invention may be advantageously applied.
Figure 2A:
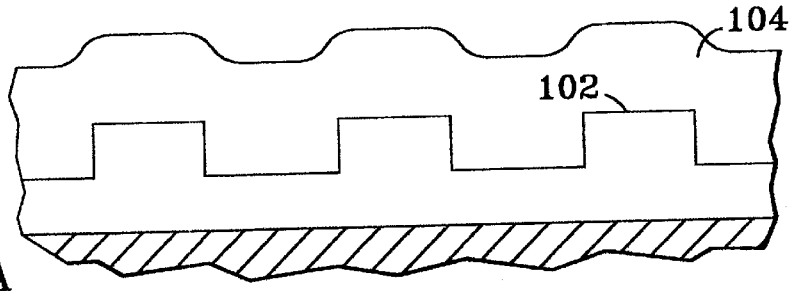
FIG. 2A shows an arrangement of polycrystalline silicon and silicon dioxide films where film removal by CMP is to be performed.
Figure 2B:
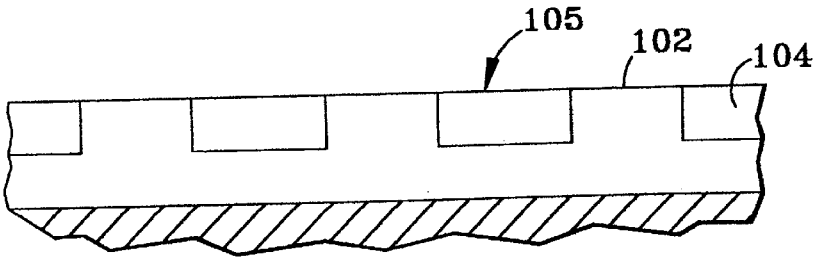
FIG. 2B shows a desired result of CMP processing of the film arrangement of FIG. 2A.
Figure 4:
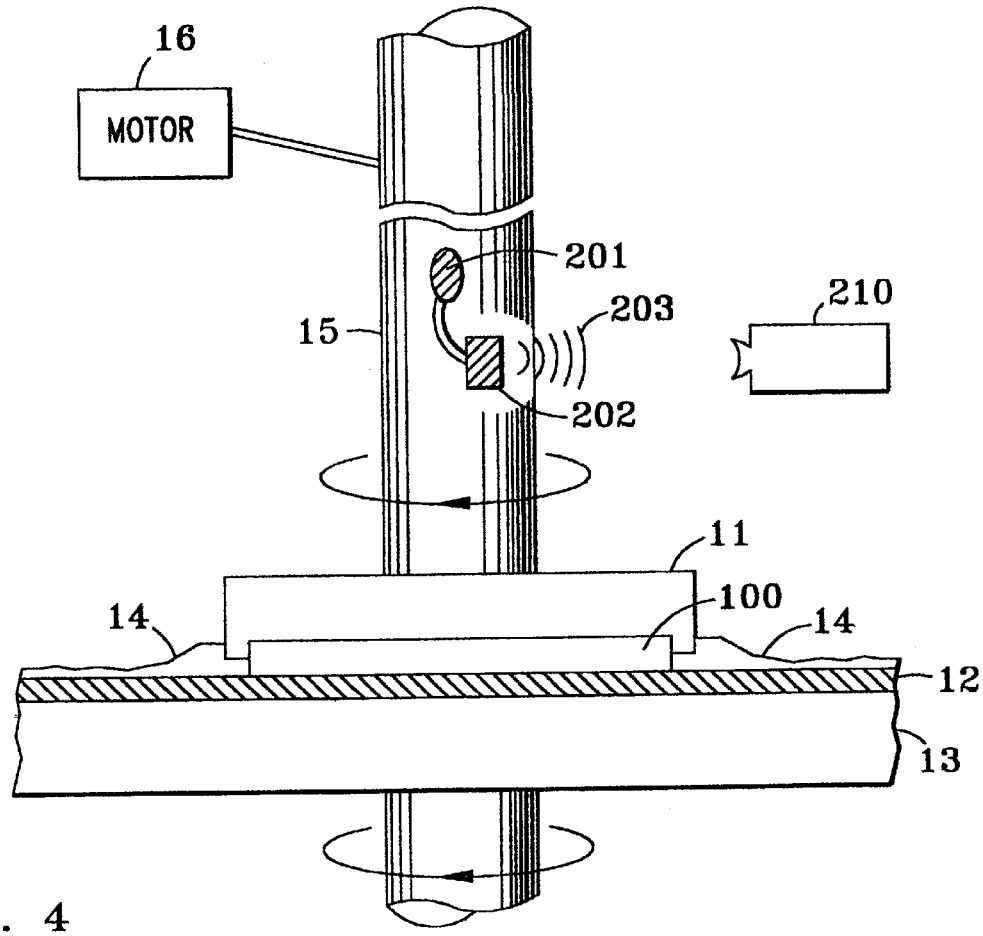
FIG. 4 shows an arrangement for monitoring the endpoint of a CMP process using a strain gauge, in accordance with a first embodiment of the present invention.

An arrangement for monitoring CMP process endpoint in accordance with the first embodiment of the present invention is shown in FIG. 4. The CMP process removes the target film (for example, the poly-Si film 104 shown in FIG. 2A). The endpoint of the process is reached when the interface with the underlying film or pattern is exposed (for example, when polySi film 104 is reduced to the level 105, thereby exposing the patterned oxide layer 102, as shown in FIG. 2B). A distinct change in friction then occurs between the polished surface and the slurry and polishing pad. In the case of the poly-Si polishing process, there is a different amount of friction when polishing a combined poly-Si/oxide layer than when polishing the poly-Si layer alone. This change in friction results in a change in torque experienced by the shaft 15. The change in torque induces a change in deformation of the shaft, which is measured by a strain gauge 201 bonded to (or embedded in) the shaft. Strain gauge 201 is connected to a transmitter 202 which broadcasts a signal 203 to a detector 210. The strain gauge 201 can be obtained from Measurement Group, Inc. and the associated telemetry system from Binsfeld Co., ATI Corp. and WDC Corp. This arrangement has been found to provide acceptable signal-to-noise ratios, whereas a conventional slip-ring type transmitting device did not.

The signal 203 indicates strain caused by deformation of the shaft 15, which in turn is directly related to torque experienced by the shaft. This arrangement therefore generates a signal indicating changes in friction between the polishing pad 12 and slurry 14 and the wafer 100. Moreover, this signal is produced in situ and in real time.

A variety of suitable strain gauges are available. A metal foil gauge has been found to be adequate for most applications. If more sensitivity is desired, a semiconductor strain gauge may be used; these gauges typically have gauge factors 100 times those of metal foil gauges.

Figure 5:
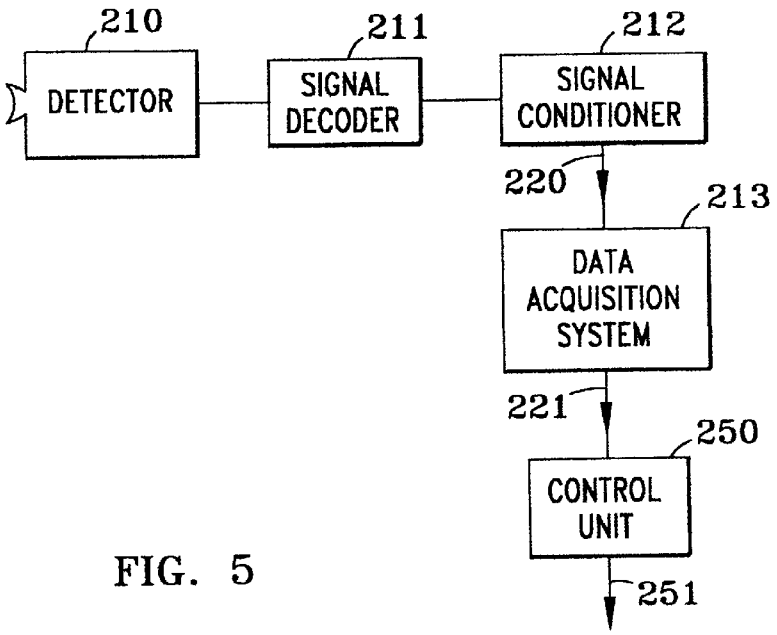
FIG. 5 is a schematic illustration of a signal processing arrangement which processes and uses an endpoint signal in accordance with the first embodiment of the present invention.

An arrangement for decoding the strain gauge telemetry signal 203 and obtaining a useful process endpoint signal is shown schematically in FIG. 5. The detector 210 inputs the encoded signal to a signal decoder 211; the decoded signal is then fed into a signal conditioner 212. The signal conditioner 212 has an output 220 in the form of voltage or current, which is then fed into a data acquisition system 213 performing digital signal processing. The digital output 221 is then input to a control unit 250 for controlling the CMP process. Control unit 250 includes a computer which performs an algorithm with signal 221 as input; according to the algorithm, the computer analyzes the shape of the signal as a function of time, thereby determining the process endpoint. The endpoint signal 251 may advantageously be fed back to the polishing apparatus 10 to automatically stop the process.

An apparatus such as described just above can detect changes in torque at a level of 0.2 microstrain. This is sufficient sensitive to detect interface changes in the polishing process.

Second Embodiment: Optical Measurement

Figure 6:
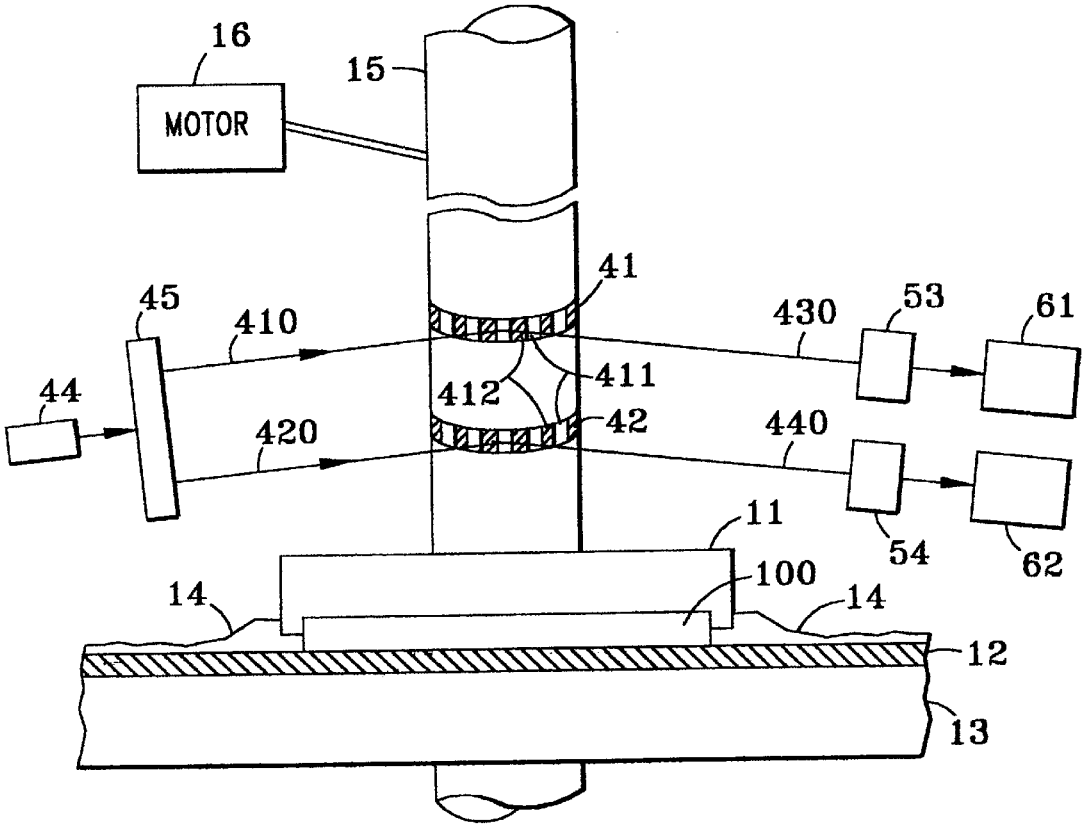
FIG. 6 shows an arrangement for monitoring the endpoint of a CMP process using an optical measurement of shaft deformation, in accordance with a second embodiment of the present invention.

FIG. 6 illustrates a second embodiment of the invention, in which changes in the torque on the shaft 15 are detected by monitoring the phase difference between two optical signals.

Two patterned rings 41, 42 are mounted on shaft 15; each ring has alternating reflecting portions 411 and non-reflecting portions 412. Alternatively, the shaft 15 may be fabricated so that the reflecting and non-reflecting portions are an integral part thereof. Light from a laser 44 is split into two beams 410, 420 using a conventional optical arrangement 45. Light beams 410, 420 are incident on rings 41, 42 respectively. The reflected beams 430, 440 are recollimated by additional optical elements 53, 54, and detected by two separate photodetectors 62. As the shaft 15 rotates, successive reflecting portions 411 on the two rings reflect the light back to the photodetectors, interrupted by non-reflecting portions 412. A train of light pulses therefore enters each detector. A deformation of the shaft 15 causes the two rings to be displaced relative to each other in the direction of rotation. This in turn causes the detected light signals to be phase-shifted with respect to each other. Accordingly, a change in the phase relationship between the pulse train detected by detector 61 and the pulse train detected by detector 62 indicates a change in deformation of the shaft 15, which in turn indicates a change in torque experienced by the shaft.

Phase-sensitive detection of the reflected light beams 430, 440 is accomplished using a 2-channel lock-in amplifier, as shown schematically in FIG. 7. The outputs 71, 72 from the two detectors 61 and 62 are fed into lock-in amplifier 701. The output 711 of the lock-in amplifier 701 corresponds to the phase difference between the detector signals 71, 72; output 711 is fed into signal conditioner 702. The signal conditioner 702 has an output 712 in the form of voltage or current, which is then fed into a data acquisition system 703 performing digital signal processing, similar to the arrangement in the first embodiment. The digital output 713 is then input to a control unit 704 for controlling the CMP process. Control unit 704 includes a computer which performs an algorithm with signal 713 as input; according to the algorithm, the computer analyzes the shape of the signal as a function of time, thereby determining the process endpoint. As in the first embodiment, the endpoint signal 714 may advantageously be fed back to the polishing apparatus 10 to automatically stop the process.

It should be noted that in this embodiment, no sensor is attached to the shaft; all mechanically sensitive components are remote from the moving parts of the polishing apparatus. Since the basis of this endpoint detection scheme is optical rather than mechanical, the signal coupling is drastically simplified and the associated coupling noise is greatly reduced, allowing a better signal-to-noise ratio than in the first embodiment.

EXAMPLE

FIG. 8A shows an example of a detected torque signal acquired during a poly-Si polishing process. The sharp change in the signal indicates that the interface between layers has been reached.

It should be noted that this apparatus detects the endpoint in accordance with a change in the torque, as opposed to a predetermined value of torque. The actual amount of torque on the shaft may vary from one polishing process to the next, so that a specific value of torque indicating the endpoint cannot be fixed. Accordingly, it is convenient to calculate the time derivative of the torque signal, as shown in FIG. 8B, and to use the peak of the derivative to indicate the process endpoint.

It will be appreciated that the endpoint for removal of any film overlying another film can be detected by monitoring the change in torque experienced by the wafer carrier shaft, in accordance with a change in friction associated with removal of the film. In the specific embodiments described above, the polishing pad 12 and table 13 have been depicted as rotating. However, it will be appreciated that this need not be the case, provided that the shaft experiences a torque as a result of the friction inherent in the film removal process.

In accordance with the present invention, methods and apparatus have been disclosed for highly sensitive detection of torque changes experienced by a shaft, using (1) a strain gauge bonded to the shaft, or alternatively (2) reflecting and non-reflecting portions on the shaft for generating trains of light pulses. Using these methods and apparatus, a clear signal change, associated with exposure of a film interface, may be observed in situations where there is no discernible change in motor current. The method and apparatus of the present invention therefore permit greatly improved process monitoring and control, particularly when there is only a slight change in friction at the film interface. Accordingly, sensitive, real-time endpoint detection and control of a CMP film removal process is provided.

While the invention has been described in terms of specific embodiments, it is evident in view of the foregoing description that numerous alternatives, modifications and variations will be apparent to those skilled in the art. Accordingly, the invention is intended to encompass all such alternatives, modifications and variations which fall within the scope and spirit of the invention and the following claims.

We claim:

1. A method for detecting an endpoint of a film removal process, said process using a film removal device having a shaft, where friction in the film removal process causes torque on the shaft, the method comprising the steps of:

providing a first reflecting portion and a second reflecting portion on the shaft, the second reflecting portion being axially displaced from the first reflecting portion;

reflecting light from said first reflecting portion and from said second reflecting portion, thereby generating respectively a first reflected signal and a second reflected signal;

detecting a phase difference between said first reflected signal and said second reflected signal; and generating an output signal in accordance with the phase difference, wherein a change in the output signal indicates a change in deformation of the shaft resulting from a change in the torque, thereby indicating the endpoint of the film removal process.

2. A method according to claim 1, further comprising the steps of:

processing the output signal to obtain a control signal for the film removal process; and controlling the film removal process in accordance with the control signal.

3. A method according to claim 2, wherein said processing step further comprises analyzing a shape of the signal as a function of time.

4. A method according to claim 2, further comprising the step of stopping the film removal process when the endpoint has been reached.

5. A method according to claim 1, wherein the film removal process comprises chemical-mechanical polishing.

6. A method according to claim 5, wherein the shaft rotates, and the film being polished is connected thereto.

7. A method according to claim 1, wherein said step of detecting a phase difference is performed using a two-channel lock-in amplifier.

* * * * *